US006053142A

United States Patent [19]

Achenbach et al.

[11] Patent Number: 6,053,142

[45] Date of Patent: Apr. 25, 2000

[54] CRANKCASE OF AN INTERNAL COMBUSTION ENGINE

[75] Inventors: Karl-Jörg Achenbach, Biedenkopf; Ulrich Bertsch, Burgstetten; Thomas Hardt, Weinstadt; Hubert Schnupke, Stuttgart, all of Germany

[73] Assignee: DaimlerChysler AG, Stuttgart, Germany

[21] Appl. No.: 09/299,191

[22] Filed: Apr. 23, 1999

[30] Foreign Application Priority Data

Apr. 25, 1998 [DE] Germany ..... 198 18 594

[51] Int. Cl.[7] ..... F02F 7/00

[52] U.S. Cl. ..... 123/195 C; 123/195 R

[58] Field of Search ..... 123/195 R, 195 C

[56] References Cited

U.S. PATENT DOCUMENTS 3,977,385 8/1976 Mansfield ..... 123/195 R
4,726,334 2/1988 Holtzberg et al. ..... 123/195 R
4,930,470 6/1990 Kabat et al. ..... 123/195 R
5,083,537 1/1992 Onofrio et al. ..... 123/195 R

FOREIGN PATENT DOCUMENTS 30 28 788 2/1981 Germany .

*Primary Examiner*—John Kwon
*Attorney, Agent, or Firm*—Klaus J. Bach

[57] ABSTRACT

In a crankcase of an internal combustion engine with lower and upper crankcase parts joined together along a separation plane extending through the axis of crankshaft bearings mounted in the transverse walls of the crankcase, the upper crankcase part has side walls with cut-outs formed therein and a cup-shaped member is disposed within the crank chamber formed between the transverse walls of the crankcase to cover the cut-outs. The cup-shaped member has an opening adjacent the respective cylinder of a cylinder block extending from the upper crankcase for accommodating a connecting rod extending between the crankshaft and a piston in the respective cylinder of the cylinder block.

8 Claims, 4 Drawing Sheets

CRANKCASE OF AN INTERNAL COMBUSTION ENGINE

BACKGROUND OF THE INVENTION

The invention resides in a crankcase of an internal combustion engine comprising a lower part and an upper part including a cylinder block having at least one cylinder, the upper and lower parts being separated along a plane extending through the center of the crankshaft bearings supported by the crankcase.

In a known crankcase of this type as shown in DE 3028788C, the side walls of the upper part and of the lower part of the crankcase are provided with weight-reducing openings which are closed on each side by various covers which are mounted onto the respective sides by screws. Since during engine operation the covers are subjected to the pressure effective in the crankcase, the covers have to be mounted by a plurality of screws in order to provide for a reliable seal. Since the effectiveness of the seal depends, among others, on the amount of torque used to tighten the screws, great care has to be taken when the covers are mounted. But even so, a sufficient engagement pressure is not insured permanently since the screws may become loose over time.

It is the object of the present invention to provide a crankcase, which is also relatively light because of openings formed in the wall which openings however are closed in a more simple and more reliable manner than it is done in the prior art arrangement.

SUMMARY OF THE INVENTION

In a crankcase of an internal combustion engine with lower and upper crankcase parts joined together along a separation plane extending through the axis of crankshaft bearings mounted in transverse walls of the crankcase, the upper crankcase part has side walls with cut-outs formed therein and a cup-shaped member is disposed within the crank chamber formed between the transverse walls of the crankcase to cover the cut-outs. Each cup-shaped member has an opening adjacent each cylinder of a cylinder block extending from the upper crankcase for accommodating a connecting rod extending between the crankshaft and a piston in the respective cylinder of the cylinder block.

With the arrangement of the openings only in the upper part of the crankcase and by covering the openings from the inside by means of a cup-shaped member inserted into the upper part of the crankcase, the openings in the crankcase walls are closed in a simple and reliable manner. No screws are needed and, during operation, the internal pressure of the crankcase forces the cup shaped member in even greater sealing engagement. To reduce the weight, the cup-like member preferably consists of plastic material or of a thin-wall metal sheet or a casting for example of a light-weight metal.

Preferably, the cup-shaped member includes at its circumferential edge, a sidewardly projecting flange which is disposed between the upper edge of the lower crankcases part and the lower edge of the upper crankcase part and which is clamped therebetween, when the two parts are bolted together. As a result, the flange is pressed into sealing engagement with a support surface on the upper part, preferably with a gasket being disposed therebetween. The cup-shaped member may also have oversize and is pressed into the upper crankcase part. For additional stabilization of the preferably thin-walled and therefore relatively unstable cup-like member in the crankcase, the semi-circular cut-outs in its side walls for the reception of the crankshaft may be surrounded by ribs which are received in corresponding grooves in the transverse walls of the upper part. If the member consists of plastic material, these ribs may be reinforced, for example, by glass fiber inserts.

An embodiment of the invention will be described below on the basis of the accompanying drawings.

DESCRIPTION OF A PREFERRED EMBODIMENT

Figure 1:
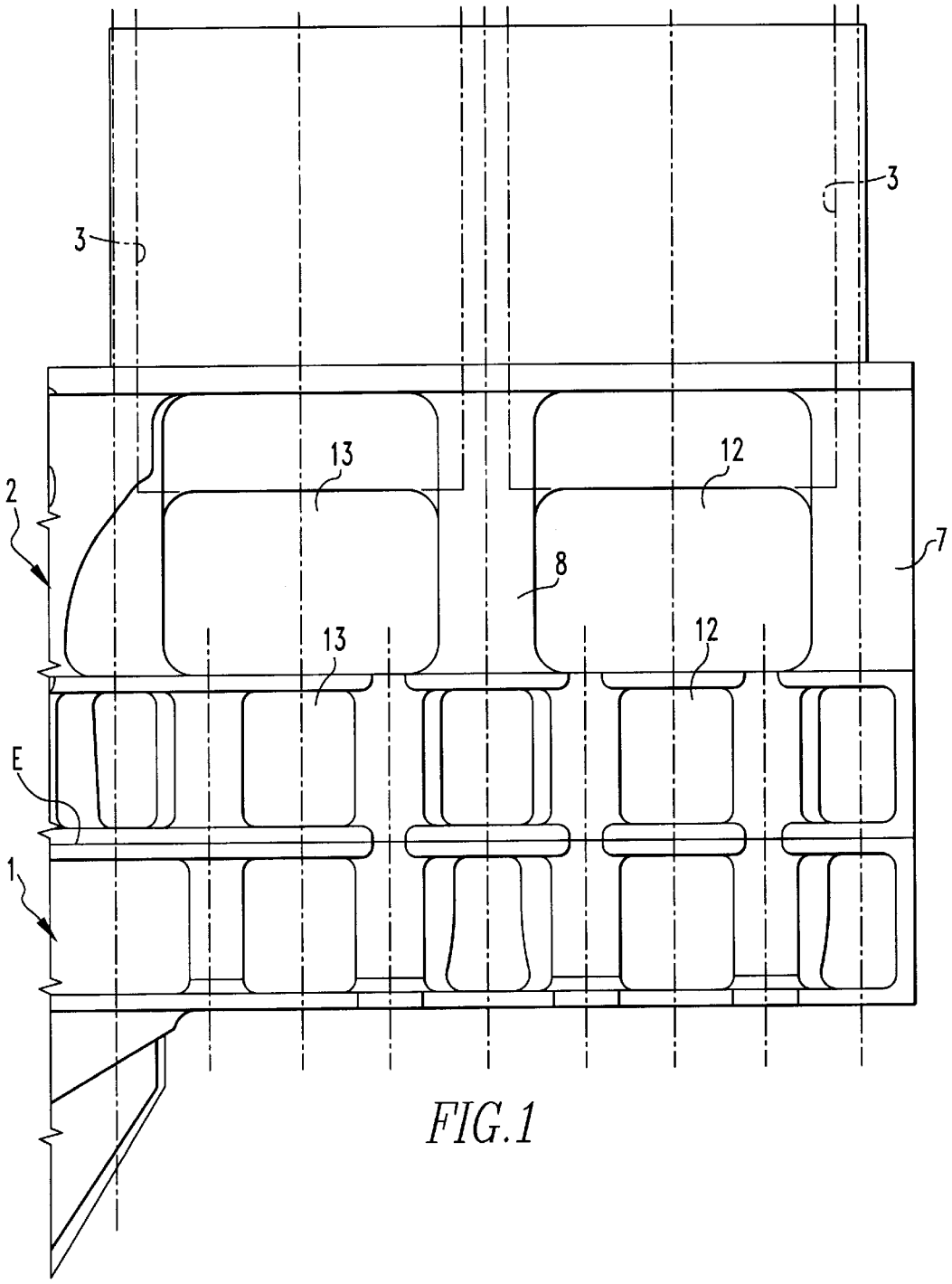
FIG. 1 is a side view of the crankcase of a two-cylinder internal combustion engine.
Figure 2:
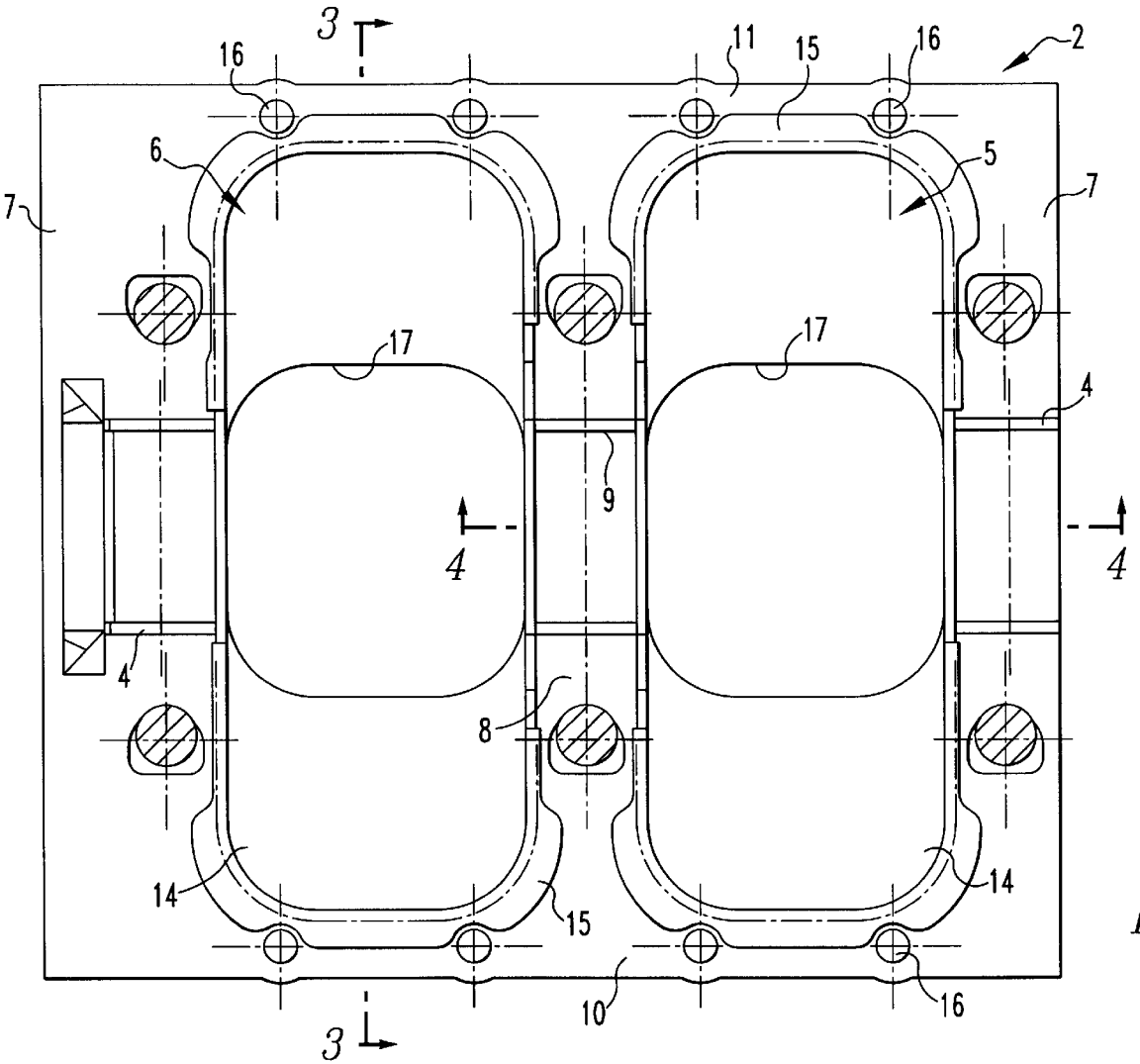
FIG. 2 is a partial bottom view of the upper crankcase part.

As shown in FIG. 1, the crankcase of an internal combustion engine comprises a lower part 1 to which an oil pan (not shown) is mounted and an upper part 2 with a cylinder block including two cylinders 3. The lower part 1 and the upper part 2 are engaged with each other along a separation plane E which extends through the center of the crankshaft bearing 4. The crankcase includes two crank chambers 5 and 6, one for each cylinder 3, which are delimited by transverse walls, that is the end walls 7 of the crankcase and the intermediate transverse wall 8. The transverse walls are composed of parts of the lower part 1 and of the upper part 2 of the crankcase. The intermediate transverse wall 8 includes an opening 9 through which the crankshaft extends. In the area of the crank chambers 5, 6, the side walls 10 and 11 of the upper part 2 include openings 12 and 13 for the purpose of saving weight.

Figure 3:
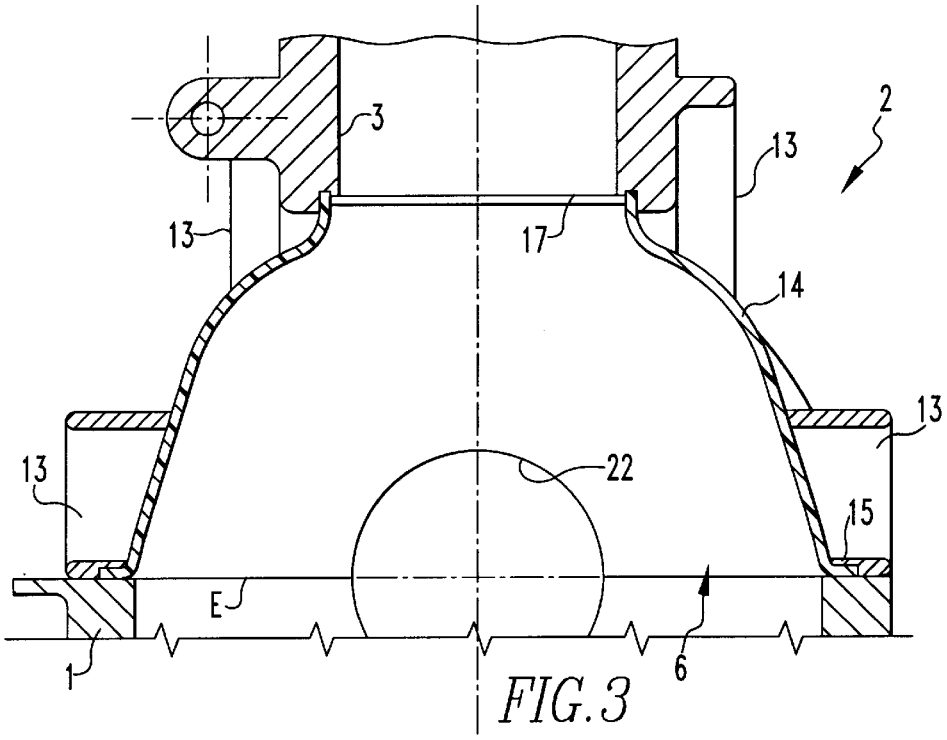
FIG. 3 is a partial cross-sectional view taken along line 3—3 of FIG. 2, but reduced in size.
Figure 4:
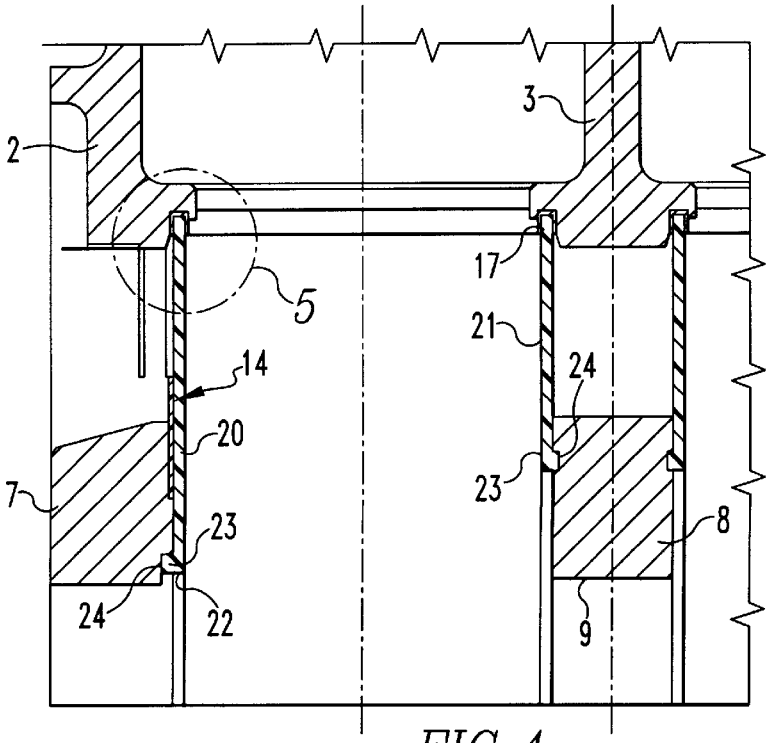
FIG. 4 is a cross-sectional view taken along line 4—4 of FIG. 2.

For closing up the openings 12 and, respectively, 13, a cup-shaped member 14 is inserted into the part of the crank chamber 5, 6 disposed in the upper part 2 of the crankcase. The cup-shaped member 14 may be made with oversize and is then pressed into the crank chambers 5, 6 so as to form a lining. As shown in FIG. 3, the cup-shaped member 14 includes at its circumferential edge a sidewardly projecting flange 15, which is disposed in the separation plane E and is clamped between the lower part 1 and the upper part 2 of the crankcase when the two crankcase parts are interconnected by bolts 16.

Figure 5:
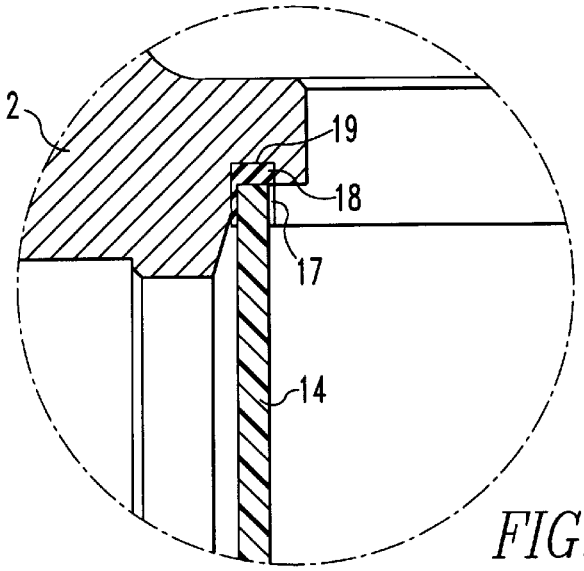
FIG. 5 is an enlarged view of the feature encircled at 5 in FIG. 4.
Figure 6:
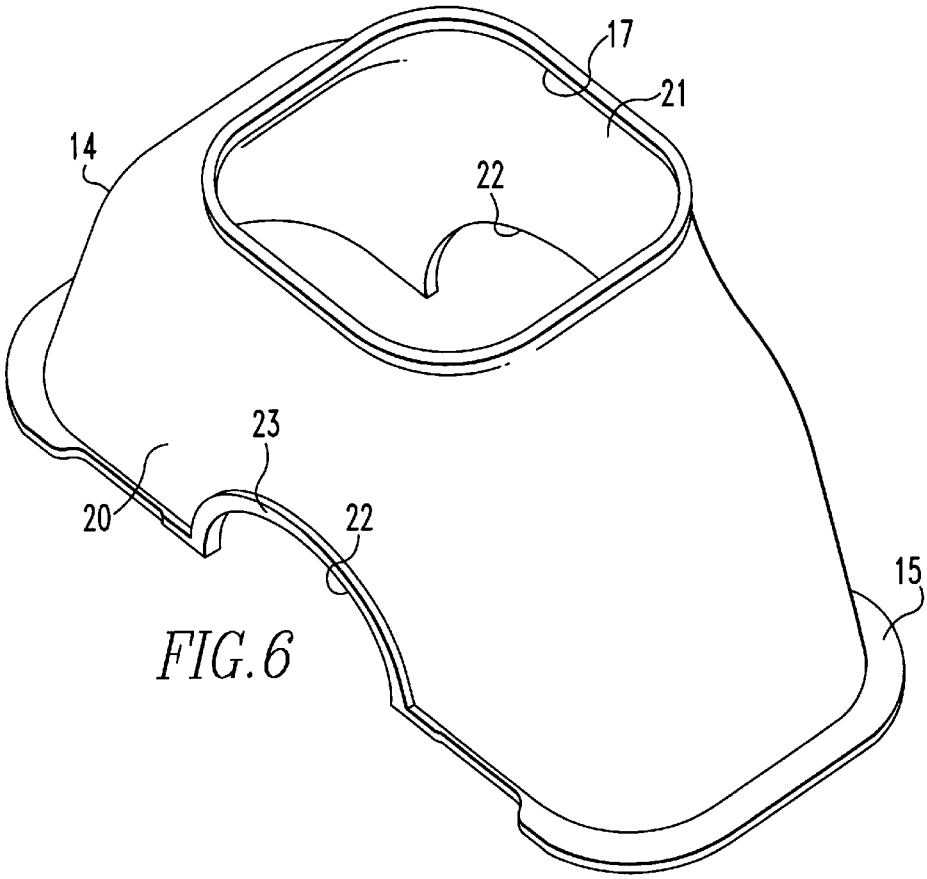
FIG. 6 is a perspective view of the cup-shaped member.

The cup-shaped member 14 includes in its end directed toward the cylinder block 3 on opening 17 through which the connecting rod (not shown) extends to a piston disposed in the respective cylinder of the cylinder block 3. As apparent particularly from FIG. 5, a seal ring 18 is disposed on the edge forming the opening 17 in the cup-shaped member 14. When the two crankcase parts 1 and 2 are bolted together the seal ring 18 disposed in a groove 19 formed in the upper part 2 of the crankcase is compressed to seal the cup-shaped member 14. The side walls 20 and 21 of the cup-shaped member 14 include semi-circular cut-outs 22 for accommodating the crankshaft of the engine. These cut-outs are surrounded by ribs 23, which are received in respective grooves 24 formed in the intermediate wall 8, or respectively, in the adjacent end wall 7 of the upper part 2.

If the cup-shaped member 14 consists of plastic material, the ribs 23 may be reinforced by glass fiber inserts. Plastic material is not only relatively light and easily shapeable, but it is also effective in attenuating noise. Alternatively, however, the component 14 may consist of a thin metal sheet or a thin light-weight metal casting.

What is claimed is:

1. A crankcase of an internal combustion engine, comprising a lower crankcase part, an upper crankcase part joined to the lower crankcase part along a separation plane and including a cylinder block said crankcase having opposite side walls and transverse walls extending between said side walls and forming crank chambers therebetween, and crankshaft bearings supported in said transverse walls in the area of said separation plane, said side walls including in the area of said upper crankcase part cut-outs in each crank chamber area and a cup-shaped member inserted into each crank chamber in said upper part so as to cover said cut-outs, each cup-shaped member having an opening adjacent said cylinder block for accommodating a connecting rod extending between a crankshaft and a piston in a respective cylinder of said cylinder block.

2. A crankcase according to claim 1, wherein said cup-shaped member includes at its edge a sidewardly projecting flange which is clamped between said lower crankcases part and said upper crankcase part of said crankcase.

3. A crankcase according to claim 1, wherein said cup-shaped member includes an edge around said spring adjacent said cylinderblock and said edge is received in a groove which is formed in said upper crankcase part and in which a seal is disposed for sealing said cup member around said opening.

4. A crankcase according to claim 1, wherein said cup shaped member has side walls provided with semi-circular cut-outs for receiving said crankshaft, said cup-shaped member having, along said semi-circular cut-outs ribs which are received in corresponding grooves formed in the transverse walls of said upper part.

5. A crankcase according to claim 1, wherein said cup-shaped member consists of a plastic material.

6. A crankcase according to claim 4, wherein said ribs include reinforcement inserts.

7. A crankcase according to claim 1, wherein said cup-shaped member consists of a sheet metal.

8. A crankcase according to claim 1, wherein said cup-shaped member consists of a light-weight metal casting.

* * * * *